United States Patent [19]

Bourgeois

[11] 4,068,496

[45] Jan. 17, 1978

[54] DEVICE FOR DRIVING NEEDLE BEDS IN A CIRCULAR KNITTING MACHINE

[75] Inventor: Norbert Paul Bourgeois, Troyes, France

[73] Assignee: ASA S.A., Roanne, France

[21] Appl. No.: 726,953

[22] Filed: Sept. 27, 1976

[30] Foreign Application Priority Data

Oct. 1, 1975 France ..... 75.30069

[51] Int. Cl.[2] ..... D04B 9/06

[52] U.S. Cl. ..... 66/27; 66/28

[58] Field of Search ..... 66/28, 27, 19, 56

[56] References Cited

U.S. PATENT DOCUMENTS

| | | | |
|---|---|---|---|
| 1,461,693 | 7/1923 | Bromley et al. | 66/28 |
| 1,988,359 | 1/1935 | Larkin | 66/19 |
| 2,428,230 | 9/1947 | Lawson | 66/28 |
| 3,181,312 | 5/1965 | Felker | 66/28 |
| 3,425,241 | 2/1969 | Planck | 66/28 |
| 3,440,837 | 4/1969 | Mishcon et al. | 66/19 X |
| 3,491,556 | 1/1970 | Mishcon | 66/28 |
| 3,521,466 | 7/1970 | Tannert | 66/19 |

FOREIGN PATENT DOCUMENTS

| | | | |
|---|---|---|---|
| 1,183,622 | 12/1964 | Germany | 66/54 |

*Primary Examiner*—Wm. Carter Reynolds
*Attorney, Agent, or Firm*—Arnold, White & Durkee

[57] ABSTRACT

A circular knitting machine has needle beds; a cylinder and a dial, and means to drive the cylinder and dial including three assemblies symmetrically arranged about three planes which intersect on a line substantially coincident with the machine axis, the assemblies thereby acting to center the cylinder and dial. It is preferred for the assemblies to include shafts and intermediate gears connecting the shafts to crown gears on the cylinder and dial, and for the cylinder to be axially adjustable by means in each assembly relative to the dial.

7 Claims, 5 Drawing Figures

DEVICE FOR DRIVING NEEDLE BEDS IN A CIRCULAR KNITTING MACHINE

This invention relates to a device for driving and positioning the needle beds of a circular knitting machine of the type having a rotating cylinder and a rotating dial.

In a circular knitting machine with two needle beds, namely a horizontal needle bed or dial and a vertical needle bed or cylinder, the synchronous rotation of the two needle beds is achieved by means of the dial and a large toothed crown or drive wheel being mounted on a central shaft, while the cylinder is firmly fixed to a second drive wheel which rotates whilst resting on an annular support fixed to the framework of the machine. The needle beds are caused to rotate by a motor, via a control shaft connected both to the two drive wheels and to the motor by a suitable transmission.

A perpetual problem in such machine is the centering and accurate adjustment of the needle beds. Another problem is as follows. When the machine is braked quickly, for example by operation a safety device monitoring yarn break, needle disengagement or the like, the central shaft supporting the dial undergoes a sudden shock. Each such shock has the effect of slightly twisting the central shaft and hence causing irregularities in the setting of the needles of the dial relative to the needles of the cylinder. These irregularities can eventually become sufficiently great to cause deterioration of the needles. It is usually attempted to avoid this by supporting the dial on a central shaft of larger diameter. However, when the shaft is large enough to resist deformation, it is found that the control shaft which drives the needle beds receives the shocks and this in turn becomes deformed. Repeated shocks on the control shaft can cause a permanent misalignment between the drive wheels of the cylinder and dial. As a result, the machine no longer turns in a true circle and it produces knitted fabric of faulty appearance.

It has been proposed to overcome this difficulty by reinforcing the control shaft with one or two supplementary shafts which are parallel to it, but with only one of the shafts being driven directly by motor, the other or others being driven by the drive wheels. While this arrangement improves synchronisation between the cylinder and dial it does not prevent deformation of the motor shaft under the repeated action of the braking shocks, because only this shaft, which is connected directly to the motor, receives the shocks.

Another problem arises from the adjustment of the spacing between the lips of the two needle beds (in order to adjust the mesh spacing) which is usually effected by adjusting the height of the central shaft supporting the dial. During this movement, it frequently happens that the dial bends or buckles, producing a non-uniform mesh spacing over the periphery of the machine and also leading to faulty appearance of the knitted fabric.

The aim of the present invention is to reduce at least some of these difficulties.

According to the present invention there is provided a circular knitting machine having needle beds: a cylinder and a dial and means to drive the cylinder and dial, such means including three assemblies symmetrically arranged about three planes which intersect on a line substantially coincident with the machine axis, the assemblies thereby acting to centre the cylinder and dial.

Preferably the machine includes, in each assembly, a shaft, each shaft being drivingly connected to a motor and arranged to drive the cylinder and dial, and each shaft having an associated braking system.

Preferably also, the machine includes, in each assembly, two intermediate gear wheels engaging toothed portions on the shaft and respectively engaging gear wheels fixed with the cylinder and dial. Advantageously, the cylinder has a toothed crown wheel machined directly into the material of the cylinder. Means may be provided in each assembly to adjust the axial position of the cylinder relative to the dial, and there may be comparators to assist in carrying out the adjustment and controlling axial spacing at the three points.

The invention will be more clearly understood from the following description which is given by way of example only with reference to the accompanying drawings in which.

Figure 1:
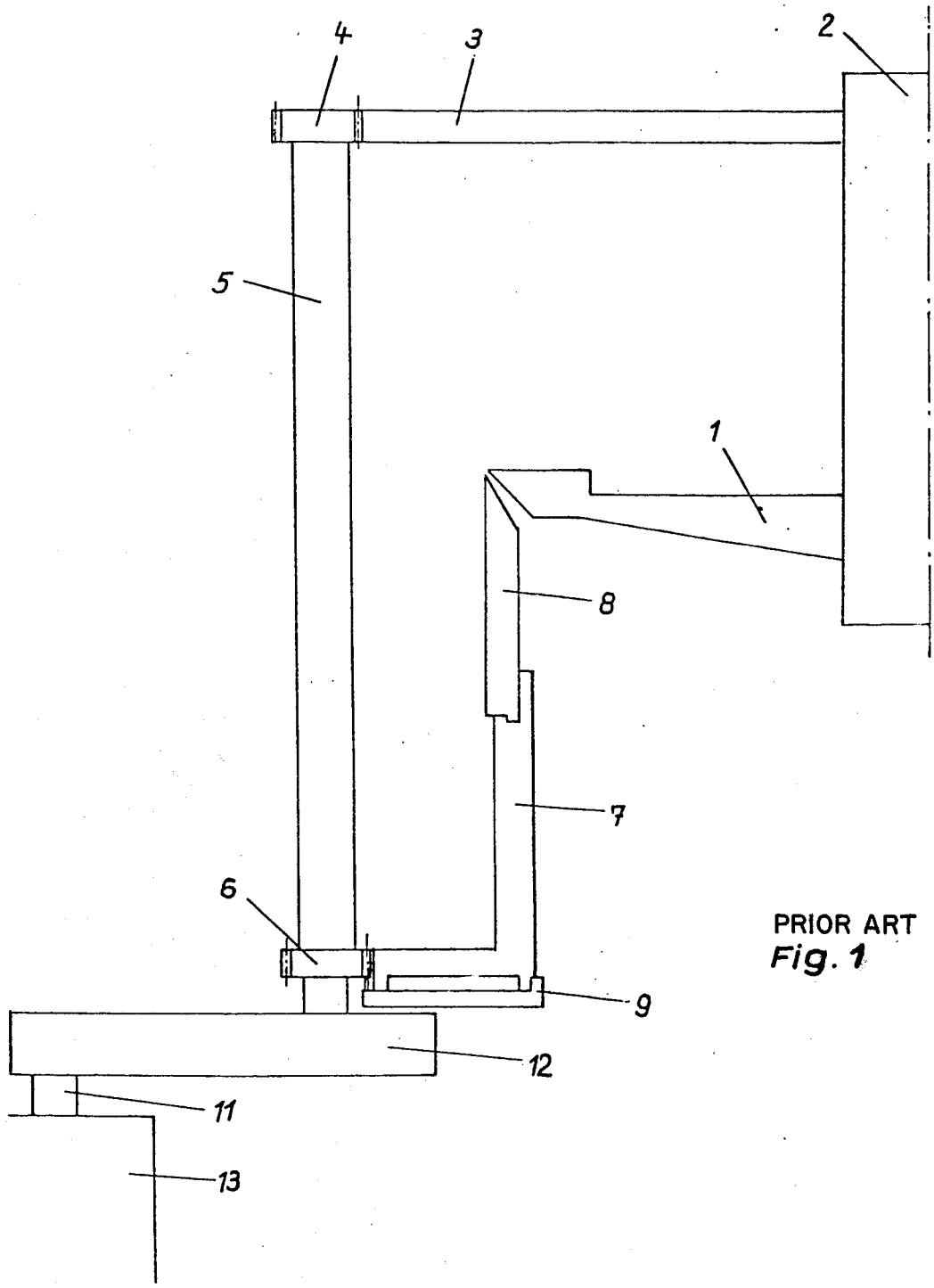
PRIOR ART Fig. 1
FIG. 1 is a schematic elevation view of the drive arrangement for the needle beds in a conventional circular knitting machine.

FIG. 1 represents the drive arrangement of the needle beds in a conventional circular knitting machine which has a dial 1 firmly fixed to a central shaft 2 which also carries a drive wheel 3, which engages with a gear-wheel 4 fixed at the upper end of a vertical control shaft 5. A gear-wheel 6, identical with the gear-wheel 4 and fixed near the bottom of the shaft 5 engages with a drive wheel 7 firmly fixed to a cylinder 8 and which, in rotation, rests on an annular support 9 fixed to the framework of the machine (which is not otherwise shown). The control shaft 5 is connected, at its lower end, to a motor shaft 11 by a known drive system 12 which can comprise gear-wheels, pullies and belts, wheel and chain combination or the like. The motor 13 is located in one of the legs (not shown) of the framework of the machine.

Figure 2:
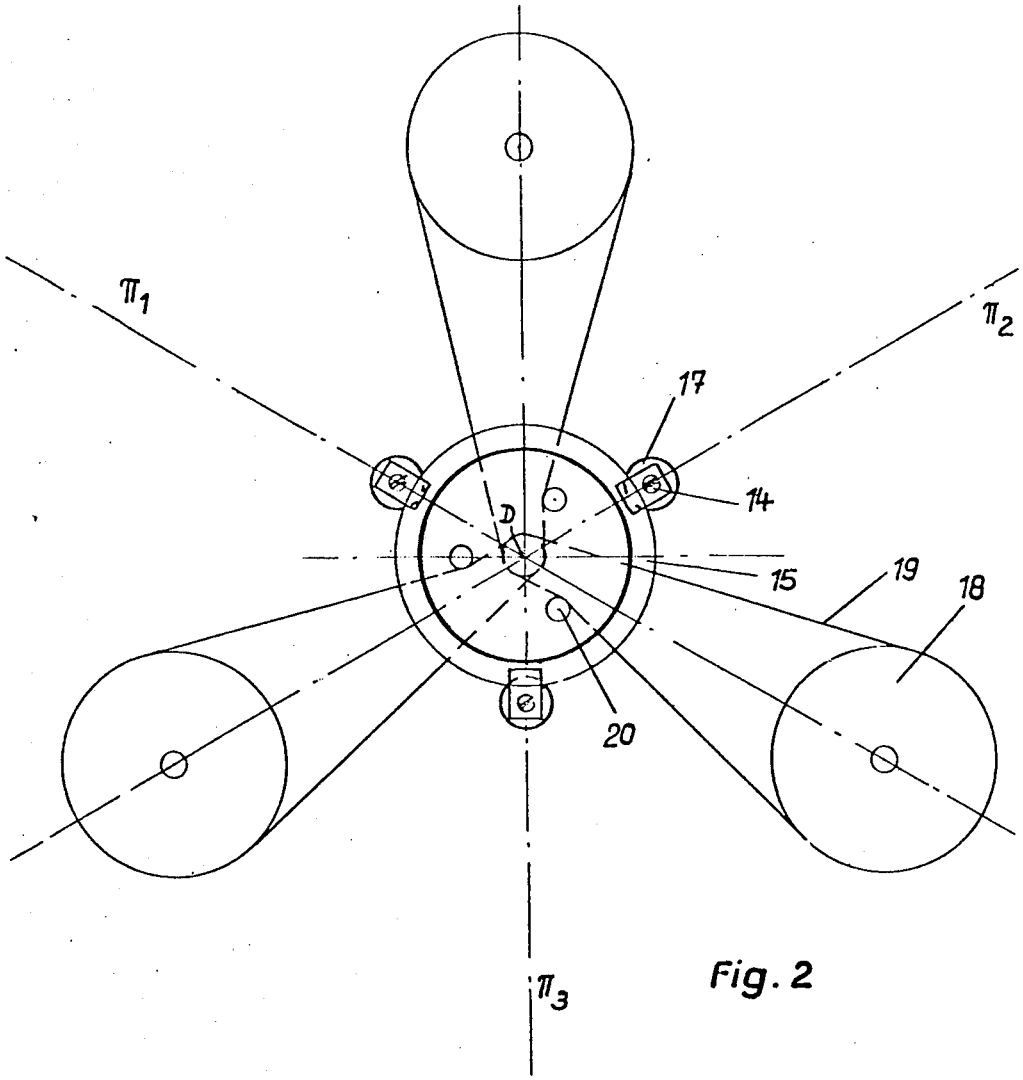
FIG. 2 is a schematic plan view of the apparatus for controlling rotation of a circular knitting machine according to the invention.
Figure 4:
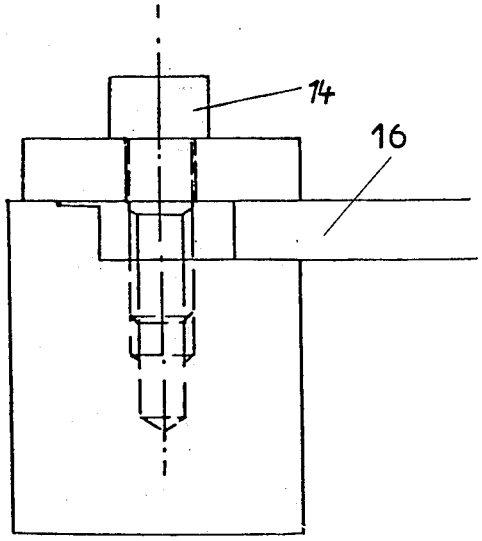
FIG. 4 is a more detailed side view of a support of the motor.

FIG. 2 is a schematic plan view of a device of the invention for driving and positioning the needle beds of a circular knitting machine. In this Figure is shown the symmetrical arrangement of three control devices relative to three planes ($\pi_1$, $\pi_2$, $\pi_3$) which intersect along one and the same vertical line D, which is substantially on the machine axis. The motor 15 occupies a central position in the upper part of the knitting machine. It is fixed to a plate 16 which rests on three supports 17 which allow radial play for centering the motor and possess locking means 14 in order to secure the motor 15 in its operating position FIGS. 3 and 4. This motor drives three pullies 18 via belts 19 which all three cooperate with the shaft of the motor 15. Tensioning devices 20 are provided. The pullies are symmetrically arranged about the three planes $\pi_1$, $\pi_2$, $\pi_3$.

Figure 3:
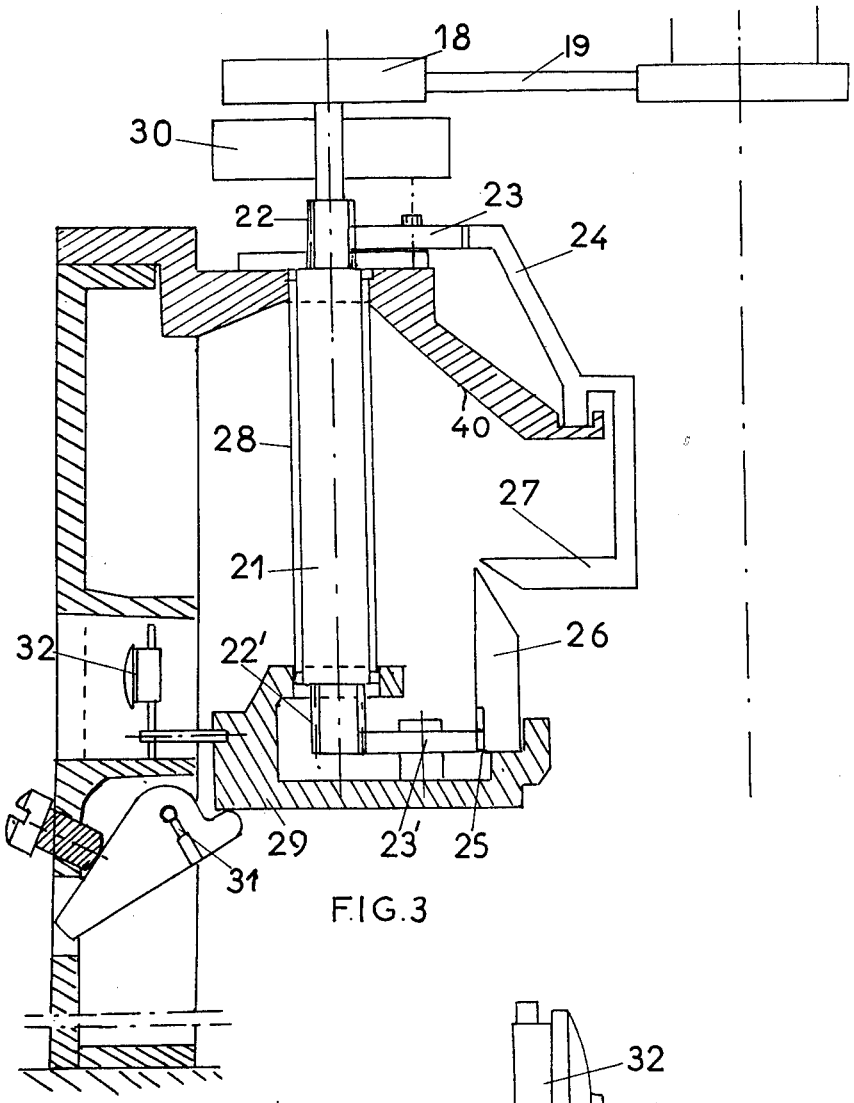
FIG. 3 represents a schematic elevation of the drive arrangement of a circular knitting machine according to the invention.

FIG. 3 shows that each pulley 18 is connected to a respective vertical shaft 21 which at its ends carries pinion gears having sets of teeth 22, 22', preferably machined into the material of the shaft. These sets of teeth, which are preferably machined simultaneously, are identical to about one-hundreth of a millimeter. The sets of teeth, 22, 22', respectively engage with intermediate gear-wheels 23, 23'. The six intermediate gear-wheels with which a machine is fitted are also preferably machined simultaneously so as to be as identical as possible. The three gear-wheels 23 engage with a drive wheel 24 of the dial whilst the three gear-wheels 23' engage with a set of teeth 25 machined at the bottom of the cylinder 26. This set of teeth 25 and the drive wheel 24 of the dial have the same basic diameter and the same number of teeth. The dial 27 is supported by members 40 extending sideways from three columns 28 which form bearings for the three shafts 21. The cylinder 26 rests on three adjustable levers 29.

Centering of the two needle beds is achieved by the six intermediate gear-wheels 23 and 23'. The fact that the six gear-wheels are identical and that the drive wheel 24 of the dial is identical with the set of teeth 25 of the bottom of the cylinder permit strict centering.

The three shaft 21 each carry an identical braking system 30. They all three participate in the control of the machine and all three equally experience shocks due to braking. However, these shocks, being distributed among the three shafts, are less intense in their action on each of the shafts than they would be on a single shaft and do not cause them to undergo deformation which can produce irregularities in the setting of the needles of the dial relative to the needles of the cylinder.

Figure 5:
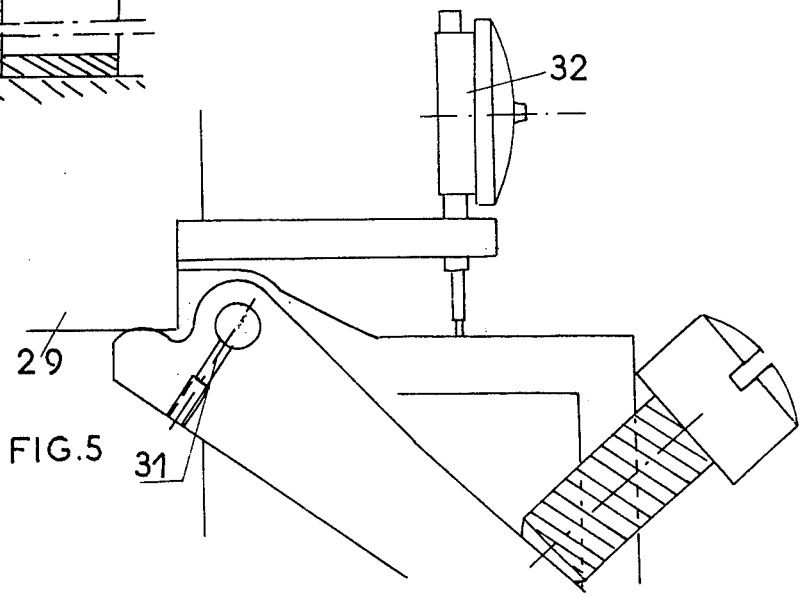
FIG. 5 shows means to control the spacing of the needle beds in the circular knitting machine.

Relative movement of the needle beds in the vertical direction in order to regulate the needle mesh spacing is effected at the three support points of the cylinder by adjustment of the levers 29. Control devices 31 (FIG. 5) acting on the levers 29 make it possible to raise or lower the cylinder relative to the dial. A comparator such as micrometer 32 is connected to each lever 29 and engages a fixed part of the machine indicate the amount of travel at each of the three points. It is thus possible to produce strictly identical travels at each of the three points, which makes it possible to provide a needle bed spacing which is constant over the entire periphery of the machine.

Any device for transmitting movement between the motor and the shafts 21 could replace the belt and the pulley arrangements described above. Also, the sets of teeth machined into the material of the control shafts could be replaced by fitted gear-wheels, although this might not show such accurate centering of the needle beds. Further, alternative systems of support for the cylinder which allow vertical travel could be used, for example a clamp located towards the inside of the machine and adjustable by means of, for example, a screw. However, the device which has been described above has the advantage of freeing the bottom of the cylinder, making it possible to withdraw the latter easily and to replace the needle beds easily, for example in order to change the gauge of the machine.

While three shafts and sets of gears have been described, a greater number could be used.

I claim:

1. In a circular knitting machine of the type having a substantially vertical machine axis and a pair of synchronously rotating needle beds comprising a horizontal dial and a vertical cylinder, an improved apparatus for driving and positioning said needle beds comprising:

a motor disposed on the machine axis;

at least three bed drive assemblies symmetrically radially disposed equidistant from the machine axis, each said assembly comprising:

a rotatably driven vertical shaft having upper and lower pinion gears disposed at the ends thereof;

an upper intermediate gear having teeth meshing with said upper pinion gear and having associated means for rotatably driving the dial;

a lower intermediate gear having teeth meshing with said lower pinion gear and having associated means for rotatably driving the cylinder;

the teeth of said pinion gears and intermediate gears intermeshing to provide synchronous drive of the dial and cylinder and strict centering thereof;

means for supporting the dial;

support means for the cylinder including means for raising or lowering the cylinder relative to the dial;

means for braking said vertical shaft;

transmission means mechanically connecting said motor to each said vertical shaft for imparting rotation to the shafts.

2. A circular knitting machine as claimed in claim 1 wherein the teeth of said lower intermediate gear intermesh with teeth machined directly on the cylinder.

3. A circular knitting machine as claimed in claim 1 wherein said motor is adjustably mounted on the upper portion of the machine for allowing radial play for centering the motor in its operating position.

4. A circular knitting machine as claimed in claim 1 wherein said transmission means comprises pullies fixedly secured to each of said vertical shafts, said pullies being rotated by belts driven by said motor.

5. A circular knitting machine as claimed in claim 1 wherein all pinion gears are substantially identical and all teeth of the intermediate gears are substantially identical thereby providing strict centering.

6. A circular knitting machine as claimed in claim 1 wherein said means for raising or lowering the cylinder comprises a lever operating on the bottom of the cylinder.

7. A circular knitting machine as claimed in claim 6 including a comparator in each bed drive assembly to indicate the adjustment of the cylinder with respect to the dial.

* * * * *